United States Patent [19]

Davis

[11] Patent Number: 5,029,859

[45] Date of Patent: Jul. 9, 1991

[54] PROTECTIVE BUMPER STRIP, ESPECIALLY FOR WIDE BODY TENNIS RACQUETS

[75] Inventor: Stephen J. Davis, New Hope, Pa.

[73] Assignee: Prince Manufacturing, Inc., Lawrenceville, N.J.

[21] Appl. No.: 335,279

[22] Filed: Apr. 10, 1989

[51] Int. Cl.[5] ..... A63B 49/14

[52] U.S. Cl. ..... 273/73 R; 273/73 C

[58] Field of Search ..... 273/73 K, 73 R, 73 C, 273/73 F, 73 D, 73 G, 73 H, 73 L

[56] References Cited

U.S. PATENT DOCUMENTS

| | | | |
|---|---|---|---|
| 3,702,701 | 11/1972 | Vaughn | 273/73 J |
| 3,805,366 | 4/1974 | Vaughn | 273/73 R |
| 4,204,681 | 5/1980 | Hall, Jr. et al. | 273/73 D |
| 4,220,335 | 9/1980 | Nobbs | 273/73 R |
| 4,265,450 | 5/1981 | Drake et al. | 273/73 R |
| 4,664,380 | 5/1987 | Kuebler | 273/73 C |
| 4,903,967 | 2/1990 | Ferrari et al. | 273/73 C |

FOREIGN PATENT DOCUMENTS

| | | | |
|---|---|---|---|
| 8614113 | 9/1987 | United Kingdom | 273/73 D |

*Primary Examiner*—Benjamin Layno
*Attorney, Agent, or Firm*—White & Case

[57] ABSTRACT

A bumper strip for tennis racquets, particularly for wide body tennis racquets, includes a groove portion that fits into the frame stringing groove and with grommet pegs that extend into the string holes in the raquet frame, and a pair of side flanges that cover the outside surface of the racquet. The flanges include a series of axially spaced, trapezoidal cutouts located between the grommet pegs so as to reduce the dead weight of the strip, without impairing the protective function of the stip or impairing its structural integrity.

9 Claims, 2 Drawing Sheets

PROTECTIVE BUMPER STRIP, ESPECIALLY FOR WIDE BODY TENNIS RACQUETS

BACKGROUND OF THE INVENTION

Most high performance tennis racquets today have frames made of a fiber-impregnated resin, particularly graphite. One shortcoming of graphite and other resin frames, however, is the tendency to develop small cracks when subjected to localized stress, which occurs if the frame is hit against a hard surface such as the ground. Once a crack forms, it tends to propogate each time the racquet hits the ball and eventually can cause the racquet to fail.

Damage is most likely to occur when returning a low shot, when the tip of the racquet is swung close to the ground. In order to protect against damage from accidental impact with the court surface, it is customary with graphite racquets to provide a plastic bumper strip over the tip region of the frame. The bumper strip has grommet pegs for the strings, so that it both acts as a bearing surface for the strings and covers the outside surface of the frame.

Recently, racquet manufacturers have introduced new graphite frames in which the cross-sectional height, i.e., the dimension perpendicular to the stringing plane, is enlarged in selected parts of the head or throat region, to produce a desired frame performance. An example of such a racquet is the Prince CTS, which is disclosed in commonly owned U.S. patent application Ser. No. 178,255, filed Apr. 6, 1988 and in which the height of the frame increases linearly from the top of grip to the racquet tip. While the geometries and resulting performance benefits of racquets offered by other companies differ, such racquets have come to be known generally as "wide body" tennis racquets. The outside surface of such racquets may be provided in the customary manner with bumper strip along the outer tip region.

SUMMARY OF THE INVENTION

The present invention is an improved bumper strip that is particularly advantageous on wide body tennis racquets. A bumper strip according to the invention includes a series of strategically spaced cutouts along the side flanges, which act to reduce the dead weight of the bumper strip without adversely affecting the protective function of the strip.

More particularly, a bumper strip according to the invention includes an elongated central groove portion having a bottom wall a pair of opposed sidewalls. A pair of elongated side flanges extend transversely from the upper edges of the respective sidewalls, such that the strip groove fits into a conventional frame stringing groove and the side flanges fit over the outside surfaces of the frame. A plurality of grommet pegs extend from the bottom wall of the groove portion and are spaced so as to fit into the normal string holes in the racquet frame.

Axially spaced cutouts are provided in the side flanges and positioned between the grommet pegs. Preferably, the cutouts are in the form of opposed trapezoid pairs on the respective side flanges, each having an inner edge parallel to the groove portion and a parallel outer edge of a larger dimension, such that the cutout sides diverge outwardly. In portions of the strip where grommet pegs are spaced relatively far apart, preferably a pair of two smaller cutouts is employed rather than one large cutout.

For better understanding of the invention, reference is made to the following detailed description of a preferred embodiment, taken in conjunction with the drawings accompanying the application.

DETAILED DESCRIPTION OF A PREFERRED EMBODIMENT

Figure 1:
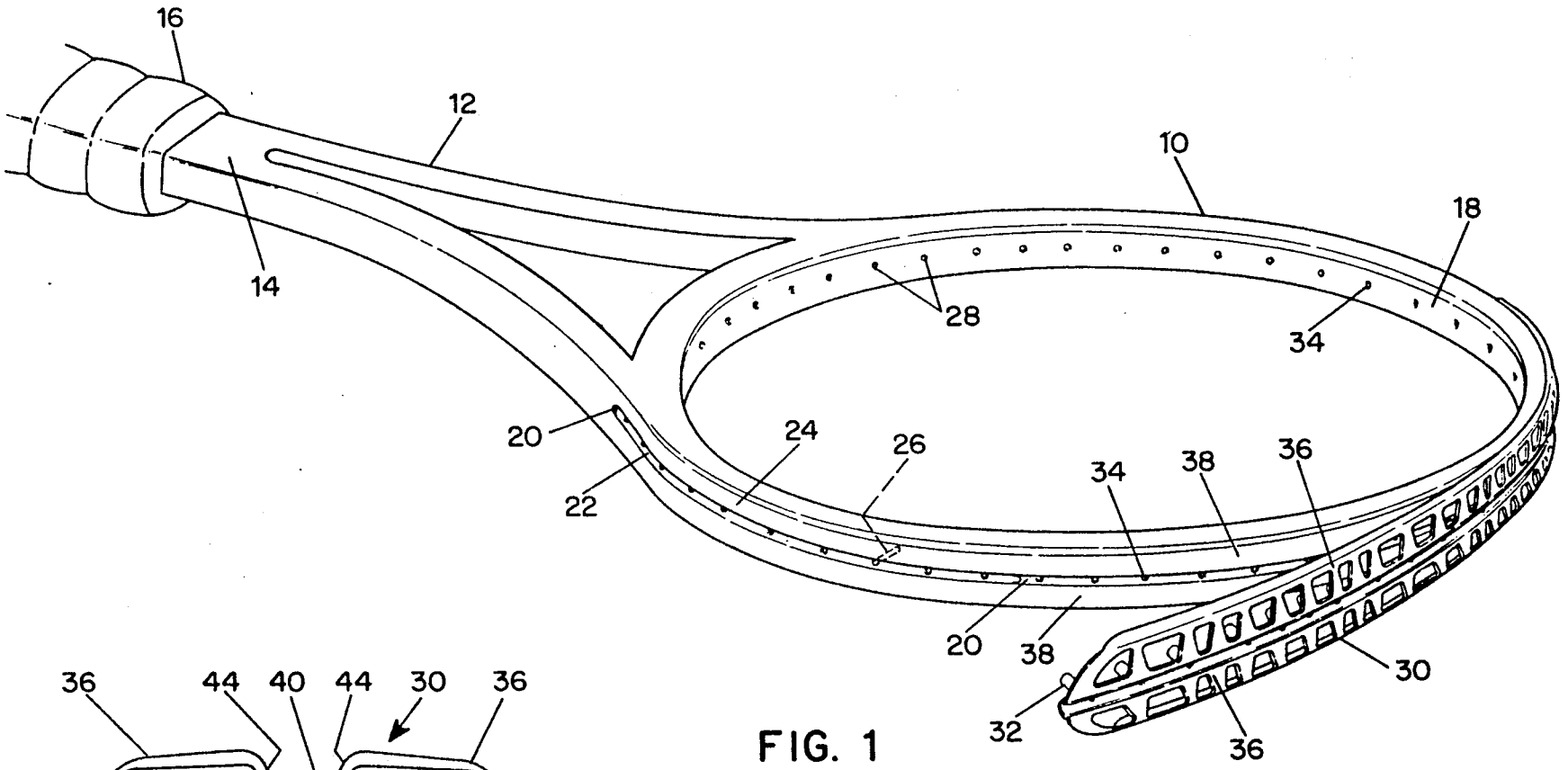
FIG. 1 is a perspective view of a wide body tennis racquet employing a bumper strip according to the invention, shown during the assembly process.

FIG. 1 illustrates a wide body tennis racquet having a head 10, a throat portion 12, and a shaft 14, in which the height "h", that is, the dimension perpendicular to the stringing plane, is larger than in conventional racquets. Preferably, the racquet is constructed according to the principles of commonly owned U.S. patent application Ser. No. 178,255, filed Apr. 6, 1988, such that the height h increases linearly from the top of the grip 16 to the tip 18. In such racquets, the height h at the tip is preferably in the range of 24–40 mm.

The racquet frame is preferably made of graphite or other fiber-impregnated resin, and provided with the customary stringing groove 20 extending about the outside surface 24 of the head. Plastic grommet strips 22 (one is shown) of a known type are disposed in the stringing groove 20 along opposite sides of the head 10. Such grommet strips have grommet pegs 26 that are spaced to project into string holes 28 in the head 10. A bumper strip 30, described further below, extends along the outside of the head 10 around its tip region 18. The bumper strip 30 is made of a bendable, and relatively flexible, plastic and includes grommet pegs 32 spaced to align with the string holes 34 in the tip portion 18 of the head, and a pair of elongated side flanges 36 that overlie the frame outer wall portions 38 to either side of the stringing groove 20.

Figure 4:
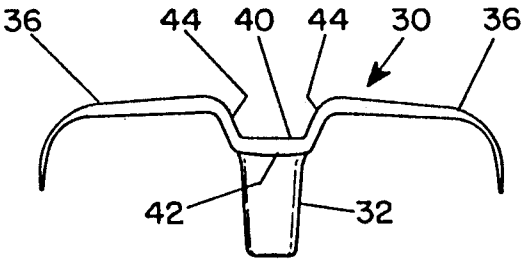
FIGS. 2, 3, and 4 are top, bottom, and end views, respectively, of a bumper strip according to the invention.
Figure 2:
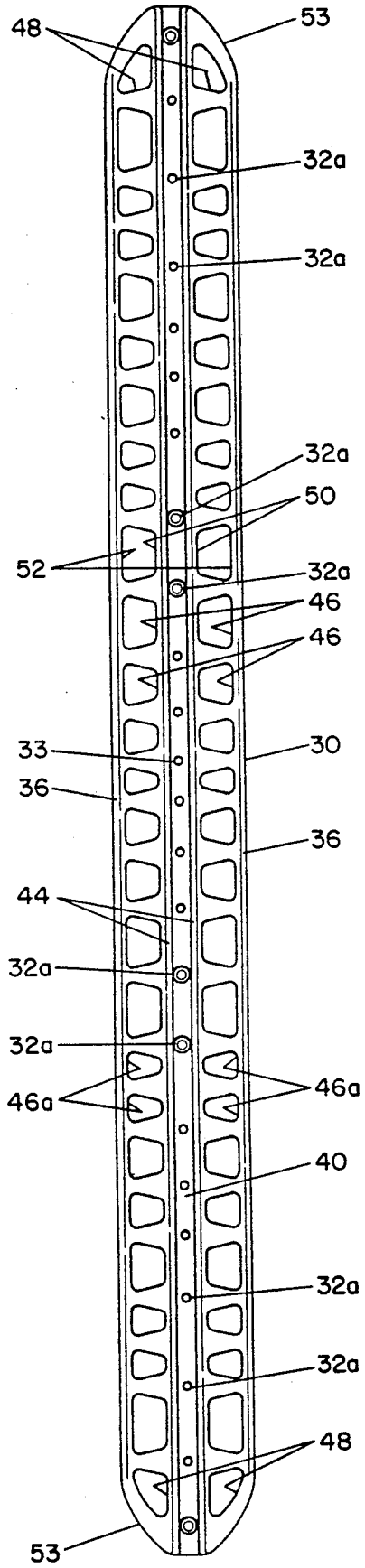
Figure 3:
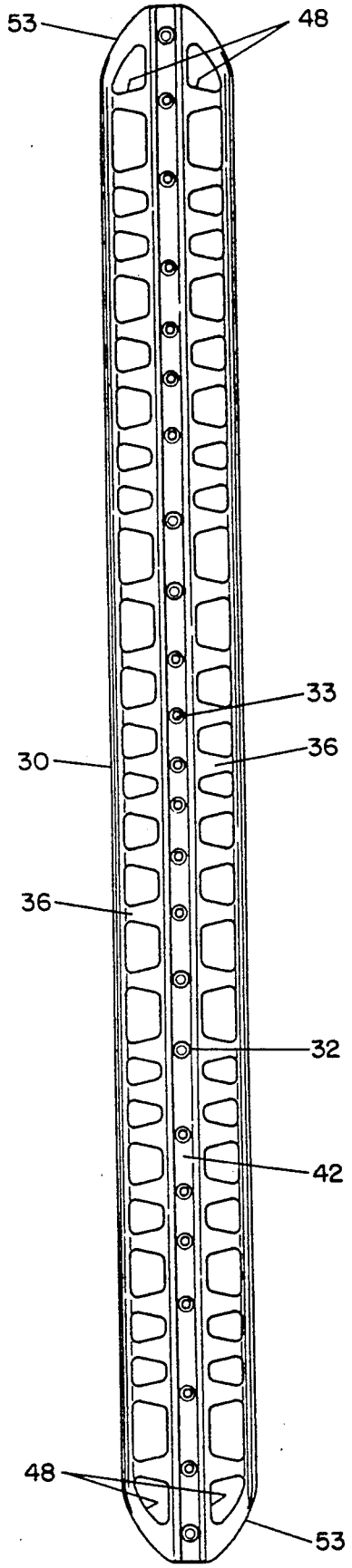

As shown in FIGS. 2–4, the bumper strip 30 is preferably molded in a flat state, and includes an elongated central groove portion 40 having a bottom wall 42 and a pair of sidewalls 44. The groove portion 40 is sized to fit in the racquet stringing groove 20. The grommet pegs 32, with bores 33 therethrough, extend from the bottom wall 42 perpendicular to the axis of the groove 40, and have variable spacing, in a known manner, according to the desired string pattern. The side flanges 36 extend from the upper edges of the sidewalls 44 and are slightly curved to follow the curvature of the racquet head outer surface 38.

The side flanges 36 include opposed pairs of cutouts 46 axially spaced between the grommet pegs 32. With the exception of the end cutouts 48 and cutouts **46*a*, the cutouts 46 are centered relative to the grommet pegs and preferably trapezoidal, with an inner edge 50 parallel to the groove 40, and an outer edge 52 parallel to the inner edge 50** and of larger dimension. In this manner, the width of the remaining plastic is greatest near the groove, and surrounding the grommet pegs, for structural integrity.

The size of the cutouts 46 is proportional to the space between the adjacent grommet pegs 32. As shown, between the pegs **32*a* having the largest spacing, preferably a pair of smaller cutouts 46a is employed, both to increase the structural integrity of the bumper strip 10 and to limit the exposed area of the underlying racquet surface, to assure that (due to curvature of the head and bumper strip) the frame surface does not project beyond the cutout edges. Also, the end cutouts 48 are closer to triangular in shape, to follow the end taper 53 of the strip 30**.

The bumper strip 30 is positioned on the racquet in the same manner as conventional bumper strips, that is, by inserting the grommet pegs 32 into the stringing holes 34 and bending the strip around the tip 18 of the racquet head, as shown in FIG. 1. Thereafter, with the grommet strips 24 in place the racquet is strung in the normal manner.

A bumper strip 30 according to the invention protects the racquet tip 18 from impact damage and abrasion if it accidentally strikes the court surface. At the same time, it reduces the amount of dead weight at the racquet tip as compared to conventional bumper strips, especially in the case of wide body racquets. The resulting decrease in the moment of inertia about the handle improves the racquet response time.

The foregoing is a description of the preferred embodiment of the invention. Variations and modifications of the exemplary embodiment will be apparent to persons skilled in the art, without departing from the inventive principles disclosed herein. All such variations and modifications are intended to be within the scope of the invention, as defined in the following claims.

I claim:

1. A protective bumper strip for a tennis racquet frame having a head with an outwardly facing stringing groove, outer wall surfaces on either side of the stringing groove, and a plurality of spaced holes in the grooves for strings, said bumper strip comprising:

an elongated central groove portion having a bottom wall and a pair of sidewalls with upper edges and sized to fit in a standard racquet stringing groove;

a plurality of grommet pegs spaced axially along the strip and extending downwardly from said bottom wall generally perpendicular to said central groove portion, said grommet pegs being aligned with the holes in the racquet head and said grommet pegs and bottom wall having bores therethrough for receiving strings; and a pair of elongated side flanges extending laterally from the upper edges of the sidewalls of said groove portion so as to overlie the outer wall surfaces of the frame; wherein each of said flanges includes a series of axially spaced cutouts.

2. A bumper strip according to claim 1, wherein said cutouts are positioned axially between the grommet pegs.

3. A bumper strip as defined in claim 2, wherein said flanges have a series of axially spaced cutouts formed as opposed trapezoids on the respective flanges, each having a lower edge parallel to said stringing groove and a parallel upper edge of a larger dimension spaced outwardly from said groove.

4. An elongated, flexible protective bumper strip for a tennis racquet frame having a head with a series of string holes and outer wall surfaces on either side of the string holes, said bumper strip having a series of axially spaced string holes for aligning with the string holes on an outer tip portion of a tennis racquet and a pair of side flanges extending laterally so as to overlie the outer wall surfaces on the tip portion of the frame; wherein each of said flanges includes a series of axially spaced cutouts.

5. A bumper strip as defined in claim 4, wherein said cutouts are positioned axially between the string holes.

6. A bumper strip as defined in claim 5, wherein said flanges have a series of axially spaced cutouts formed as opposed trapezoids on the respective flanges, each having a lower edge parallel to said string holes and a parallel upper edge of a larger dimension spaced outwardly from said lower edge.

7. In combination a wide body, fiber-impregnated resin tennis racquet frame and a protective bumper strip;

said racquet frame having a head with an outwardly facing stringing groove, outer wall surfaces on either side of the groove, and a plurality of spaced holes in the grooves for strings; said frame further having a throat and a shaft; and wherein said head includes an outer tip region having a height greater than other portions of the frame; and said bumper strip being disposed about the frame outer tip region and comprising an elongated central groove portion disposed in said stringing groove about said outer tip portion, a plurality of grommet pegs extending from the central groove portion into the frame string holes; and a pair of elongated side flanges extending laterally from the central groove portion and overlying the outer wall surface of the frame tip region, and wherein each of said flanges includes a series of axially spaced cutouts.

8. The combination as set forth in claim 7, wherein said cutouts are positioned axially between the grommet pegs.

9. The combination as set forth in claim 8, wherein said flanges have a series of axially spaced cutouts formed as opposed trapezoids, on the respective flanges, each having a lower edge parallel to said stringing groove and a parallel upper edge of a larger dimension spaced outwardly from said groove.

* * * * *